United States Patent [19]

Mollard et al.

[11] 4,004,988

[45] Jan. 25, 1977

[54] METHOD OF PREPARING SODIUM CHLORATE BY ELECTROLYSIS

[75] Inventors: Paul Mollard, Sainte Foy les Lyon; Pierre Lakodey, Saint Priest, both of France

[73] Assignee: Produits Chimiques Ugine Kuhlmann, Paris, France

[22] Filed: Sept. 25, 1974

[21] Appl. No.: 509,057

[30] Foreign Application Priority Data

Sept. 25, 1973 France ..... 73.34248

[52] U.S. Cl. ..... 204/95; 204/90

[51] Int. Cl.[2] ..... C25B 1/26

[58] Field of Search ..... 204/90, 95, 103

[56] References Cited

UNITED STATES PATENTS

| | | | |
|---|---|---|---|
| 2,133,290 | 10/1938 | Fraser | 204/90 |
| 2,433,601 | 12/1947 | Comstock | 423/186 |
| 2,511,516 | 6/1950 | Schumacher | 204/95 |
| 3,366,677 | 1/1968 | Quimby | 260/502.4 P |
| 3,607,688 | 9/1971 | Inoue et al. | 204/90 |
| 3,706,635 | 12/1972 | Kowalski | 204/52 R |

FOREIGN PATENTS OR APPLICATIONS

| | | | |
|---|---|---|---|
| 205,103 | 10/1924 | United Kingdom | 204/94 |
| 764,013 | 12/1956 | United Kingdom | |
| 1,104,728 | 2/1968 | United Kingdom | |

OTHER PUBLICATIONS

Chemie Ing. Lechniek, 43 Jahrg. pp. 173–176, (1971).

Van Wazer, "Phosphorus and its Compounds," 1961, pp. 1800 & 1801.

*Primary Examiner*—T. Tung

*Attorney, Agent, or Firm*—Pennie & Edmonds

[57] ABSTRACT

A method for preparing sodium chlorate comprises electrolyzing aqueous sodium chloride in the presence of at least one phosphorus-containing agent for complexing alkaline earth impurities, thereby advantageously extending the periods of uninterrupted satisfactory cell operation at substantially constant applied potential and facilitating the cleaning of electrodes between such periods.

1 Claim, No Drawings

METHOD OF PREPARING SODIUM CHLORATE BY ELECTROLYSIS

The present invention relates to an improvement in the manufacture of sodium chlorate by electrolysis of aqueous sodium chloride and more particularly to a means of overcoming the disadvantages caused by the presence of alkaline earth cations in the electrolyte.

BACKGROUND OF THE INVENTION

In the discussion herein, the term anode defines the electrode at which electrons are taken from the electrolyte solution or bath and the term cathode defines the electrode at which electrons are supplied to said bath. Conductivity of the electrolytic current within the bath is carried out by the simultaneous migration of negatively charged anions to the anode and of positively charged cations to the cathode.

The partial reactions taking place at the respective electrodes in the particular process to which this invention relates can be represented as follows. At the anode, chloride ions and hydroxyl ions give up electrons according to the overall anodic reaction $$Cl^- + 6\ OH^- \rightarrow ClO_3^- + 3\ H_2O + 6e$$

and at the cathode, water molecules accept electrons from the cathode according to the overall cathodic reaction $$6\ H_2O + 6e \rightarrow 3\ H_2 + 6\ OH^-$$

Since there is no diaphragm in the cell, mixing occurs, facilitated naturally by the evolution of hydrogen gas and optionally enhanced by mechanical agitation. Thus the hydroxyl ion formed at the cathode is made readily available for the anodic reaction.

Now both the water and the technical grade of sodium chloride commonly used in industrial manufacture of sodium chlorate almost always contain cations of the alkaline earths, particularly calcium, and also magnesium. These alkaline earths become deposited on the cathode, usually as carbonate if the anode is graphite or substantially as hydroxide when the anode is a metal, in the form of a closely compacted scale which adheres closely to the cathode, tending to insulate the cathode electrically and significantly thus to increase the resistance of the cell, necessitating a substantial increase in the total electrical potential applied across the terminals of the cell in order to maintain a constant electric current. The formation of compactly textured deposit becomes more rapid when the temperature is raised or when the electric current density is increased.

Another harmful effect of alkaline earth cations occurs when the anodes are made of a metal covered with a surface layer of an electrochemically active substance, as exemplarily titanium covered with a layer of ruthenium oxide. The alkaline earth cations can facilitate building up anodic deposits injurious to good functioning of the anode.

Thus the presence of alkaline earth cations in the electrolyte leads on the one hand to an increase in the specific energy consumed and on the other to the necessity of submitting the cathodes and cells to a periodic cleaning. The need for such cleaning is all the more frequent when the working temperature is raised and/or when the electrical current density is increased. This tends to cancel the advantages which accrue from the use of specially coated metal anodes, such as titanium coated with ruthenium oxide. The major interest in using such special electrodes is to permit electrolysis at high temperature and under high current density. However the frequent cleaning action which is then required risks deterioration of the anodes.

The cleaning operation is itself cumbersome, involving stages of stopping the electrolysis, emptying the cell, scouring the anodes, rinsing the cell, reintroducing the electrolyte and starting up again. Inasmuch as this procedure involves work of great magnitude, it is usually considered inadvisable to interrupt cell operation in this manner unless the coating has accumulated to extreme proportions.

SUMMARY OF THE INVENTION

A means has now been found whereby sodium chlorate can be manufactured electrolytically with avoidance of the above described multiple disadvantages originating from the presence of alkaline earth cations.

Briefly stated, the present invention provides a method for preparing sodium chlorate which comprises electrolyzing an aqueous solution of sodium chloride in the presence of a suitable amount of at least one phosphorus-containing complexing agent capable of binding alkaline earth cations. Said complexing agent is a phosphoric or polyphosphoric or metaphosphoric acid or an organophosphonic acid having at least two phosphonic acid groups bound to the same molecule, or an alkali-metal salt of these acids.

The mechanism whereby the complexing agent operates to provide the advantages of this invention is not completely understood. It is not a simple matter of sequestering the alkaline earth cations in the usual sense of producing soluble complexes or chelate compounds. Up to about 80% of the alkaline earth cations initially present in the electrolyte bath are still deposited on the electrodes, but in spite of this, it has been surprisingly found that the electrolysis can be maintained at an efficient production level for more than 1000 hours without requiring any increase in the applied electric potential. Cleaning of the electrodes is required less frequently and the cleaning is accomplished with substantially less difficulty.

DETAILED DESCRIPTION

The complexing agents which can be used in carrying out the method of the present invention are the mono- and polyphosphates generally and also the organophosphonates having a plurality of phosphonate groups per molecule. These agents can be used singly or in combination.

The term "mono- and polyphosphates generally" as used herein designates the phosphates having the formula $P_nO_{3n+1}M_{n+2}$ and those commonly called metaphosphates having the formula $(PO_3M)_n$ wherein M is hydrogen or an alkali metal and n is a whole number equal or greater than 1. Thus the complexing agent added to the electrolyte can be, illustratively, orthophosphoric acid $H_3PO_4$, sodium orthophosphate or trisodium phosphate e.g. the dodecahydrate (TSP), pyrophosphoric acid $H_4P_2O_7$, sodium pyrophosphate or dipolyphosphate (TSPP), disodium dihydrogen pyrophosphate $Na_2H_2P_2O_7$ commonly called sodium acid pyrophosphate, anhydrous or as hexahydrate, trisodium pyrophosphate, anhydrous or as heptahydrate, sodium trihydrogen pyrophosphate, pentasodium tripolyphosphate $Na_5P_3H_{10}$, (STPP), metaphosphoric acid $HPO_3$, sodium mono-metaphosphate $NaPO_3$, sodium trimetaphosphate $Na_3(PO_3)_3$, sodium tetrametaphosphate $Na_4(PO_3)_4$ or sodium hexametaphosphate or Graham's salt $(NaPO_3)_6$ or its technical grade mixtures known variously as calgon, quadrafos or micromet.

The organophosphonates used in this invention are compounds having at least two phosphonic or phosphonate groups bound to to the same molecule by phosphorus-carbon bonds. Thus they include exemplarily (ethylenedinitrilo) tetramethanephosphonic acid, also known as ethylenediaminetetramethylenephosphonic acid $(H_2O_3PCH_2)_2—N—CH_2—CH_2—N(CH_2PO_3H_2)_2$; (2) nitrilotri (methanephosphonic acid) $N(CH_2PO_3H_2)_3$; (3) 1-hydroxyethanediphosphonic acid

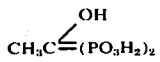

and their alkali metal salts, exemplarily tetrasodium (ethylenedinitrilo) tetramethane phosphonate.

Such polyphosphonic compounds can be termed chelating agents to describe their ability to coordinate the calcium or magnesium ion in more than one position, compounds (1), (2) and (3) being respectively quadridentate, terdentate and bidentate. It is pertinent to point out, however, that these polyphosphonic chelating agents have a stability in the electrolyte and electrolysis of this invention which is not shared by the more commonly known chelating agents such as (ethylenedinitrilo) tetra-acetic acid or diethylenetriamine pentaacetic acid. The acetic acid derivatives are not useful in the present invention because they are susceptible to both chemical and electrochemical oxidation and decompose in the electrolytic medium.

The complexing agents used in this invention can be added in any sequence to the electrolyte medium. Thus they can be added to the water used to dissolve the sodium chloride or they can be added to the aqueous mother liquor or electrolyte bath containing sodium chloride, sodium chlorate and conventional small amounts of anti-corrosive adjuvants such as dichromates. They can also be formed in situ within the electrolyte from precursor substances convertible to the complexing agent by chemical or by electrolytic steps such as by oxidation at the anode or by chemical means. Illustrative of phosphorus compounds thus capable of generating phosphates, polyphosphates and/or metaphosphates under the conditions of the electrolysis producing sodium chlorate, there are the oxidizable compounds of phosphorus having (−III) oxidation state, exemplarily phosphine; elemental phosphorus itself, having oxidation state (O); compounds of phosphorus having (+I) oxidation level, exemplarily hypophosphorous acid $H_3PO_2$ and the alkali metal hypophosphites; compounds of phosphorus having (+III) oxidation level, including the trihalides of phosphorus $PCl_3$, $PBr_3$, $PI_3$, $PF_3$; compounds of phosphorus having (+IV) oxidation state, exemplarily hypophosphoric acid $H_4P_2O_6$ and its alkali metal salts. Also useful as precursors are those compounds of phosphorus having (+V) oxidation state which can be hydrolyzed in the aqueous electrolytic bath to give phosphates or polyphosphates, such as the pentahalides and oxyhalides including $PCl_5$, $PBr_5$, $PI_5$, $POCl_3$, $POBr_3$ and the like.

The complexing agents of the present invention do not completely solubilize the alkaline earth cations within the electrolyte solution and do not completely prevent formation of calcareous deposits on the cathode. The cathodic deposit, however, forms a scale which is unexpectedly less compact and less adherent and permits continued operation for long periods of time without the usually required increase in applied electric potential. Furthermore, the chemical action of the complexing agent removes a large fraction of the alkaline earth cations during the very course of electrolysis in the form of an easily filtrable precipitate.

The concentration of complexing agent present in the electrolyte according to the method of this invention can be from about 0.5 to 10 times the concentration stoichiometrically equivalent to the alkaline earth concentration. As a guidance to adjusting the amount of agent used, the raw bath is analyzed for content of alkaline earth cations, and minor adjustments to optimize performance are made empirically while holding the several parameters of electrolysis constant, such as temperature; ph, which can be from about 6 to 7; current density anode identity and mode of agitation.

The variables of concentration, pH and the several other electrolysis parameters including those mentioned above are statistically interactive. The optimum combination of these variables can be determined by statistical analysis of controlled experiments to obtain a desired balance between the amount of electrochemical deposit and chemical precipitate.

The chemical nature of the precipitate obtained varies depending on whether simple phosphates or polyphosphates are used. The precipitate can be a simple or complex, more of less basic, phosphate of calcium, barium, magnesium, etc. A very important advantage resides in the fact that the precipitate can be removed completely from the circulating electrolyte in a simple manner. When, as is commonly the case, the electrolyte supply passes successively through a series of cells, the electrolyte can be filtered as it passes from cell to cell. Under optimum conditions, it is possible to obtain the precipitate in the form of a dense sediment whose particles are sufficiently large to be separated by simple decantation, even when the electrolyte has a mass per unit volume of 1.3–1.4 grams/cc.; it is then possible to carry out easy filtration before recirculating the electrolyte back to the first cell.

The organophosphonic acids mentioned above also have the advantage of stopping injurious effects of alkaline earth cations while at the same time showing less tendency to purely chemical precipitation.

In summary, the numerous advantages of the use of complexing agents according to the method of this invention include a decisive elimination of a large fraction of alkaline earth impurities by simple chemical precipitation in the form of easily filtrable solids and the deposition of substantially the remainder of the alkaline earths on the cathode with a low degree of compactness and adhesion and without requiring an increase in the applied electric potential. The cathodic deposit is easily removed by a simple spray of water. There is furthermore a substantial and economically significant reduction in the frequency required for stopping the process in order to clean the cathodes inasmuch as the deposit thereon involves only a small fraction of the total alkaline earths originally present in the electrolyte and a rapid rise in required potential does not occur.

This invention will be further illustrated by description in connection with the following specific example of the practice of it wherein, as also elsewhere herein, proportions are in parts by weight unless stated otherwise.

EXAMPLE 1

An electrolytic production of sodium chlorate is carried out wherein the aqueous electrolyte composition varies within the following levels:

| | grams/liter |
|---|---|
| Sodium chloride | 100 to 140 |
| Sodium chloride | 450 to 600 |
| Sodium hypochlorite | about 3 |
| Sodium dichromate | 5 to 7 |

The pH of the electrolyte is maintained at 6 to 7. The electrolyte entering the cell contains about 60 to 100 ppm of calcium. According to the procedure of the present invention there are added about 0.5 to 2 grams of sodium tripolyphosphate per kilogram of electrolyte solution.

The anode is made of titanium covered with a layer of ruthenium oxide.

Electrolysis is carried out at 40–80° C with a current density of 10 to 30 amperes per square decimeter. The volume of electrolyte is maintained at about 40 to 70 cubic centimeters per ampere of current. Mixing of the electrolyte is accomplished by the rising bubbles of hydrogen gas also formed by the electrolysis. The yield of sodium chlorate produced per Faraday is between 95 and 96% of the theoretical amount calculated from the equation.

$$NaCl + 3H_2O + 6 \text{ Faradays} \rightarrow NaClO_3 + 3H_2\uparrow$$

After passage through a single electrolytic cell unit the electrolyte solution is filtered and found to contain only 5 to 10 ppm of calcium (corresponding to 5 to 16% of the calcium in the entering electrolyte.)

The precipitate removed by filtration is found to contain an amount of calcium corresponding to about 20 to 40% of the total entering calcium. The remainder of the calcium, calculated by subtraction to amount to about 54 to 75% of the original total, is presumably deposited on the cathode but does not cause any need for increasing the applied electrical potential even after more than 1000 hours of operation.

The calcium obtained in the separated chemical precipitate corresponds to about 20 to 80% of the total calcium introduced. Although the remaining calcium (amounting to about 80 to 20% of said total calcium) is deposited on the cathode, it does not cause any need for increasing the applied electrical potential even after more than 1000 hours of operation.

We claim:

1. A method for preparing sodium chlorate which comprises electrolyzing an aqueous solution of sodium chloride in the presence of at least one phosphorus-containing complexing agent which is a phosphoric, polyphosphoric or metaphosphoric acid or an alkali-metal salt thereof in an amount of from about 0.5 to 10 times the concentration stoichiometrically equivalent to the alkaline earth concentration in said aqueous solution, wherein said presence of complexing agent is effected by adding to said aqueous sodium chloride solution a phosphorus substance capable of generating phosphates, polyphosphates or metaphosphates under the conditions of the electrolysis, said substance being phosphine, elemental phosphorus, hypophosphites, hypophosphates, phosphorus halides or phosphorus oxyhalides.

* * * * *